US009412502B2

(12) United States Patent
Magner

(10) Patent No.: US 9,412,502 B2
(45) Date of Patent: Aug. 9, 2016

(54) METHOD OF MAKING A DOWN-HOLE CABLE HAVING A FLUOROPOLYMER FILLER LAYER

(71) Applicant: Rockbestos Surprenant Cable Corp., East Granby, CT (US)

(72) Inventor: Scott Magner, South Glastonbury, CT (US)

(73) Assignee: Rockbestos Surprenant Cable Corp., East Granby, CT (US)

( * ) Notice: Subject to any disclaimer, the term of this patent is extended or adjusted under 35 U.S.C. 154(b) by 0 days.

(21) Appl. No.: 14/139,013

(22) Filed: Dec. 23, 2013

(65) Prior Publication Data

US 2014/0110146 A1 Apr. 24, 2014

Related U.S. Application Data

(63) Continuation-in-part of application No. 13/071,941, filed on Mar. 25, 2011, now abandoned.

(60) Provisional application No. 61/318,482, filed on Mar. 29, 2010.

(51) Int. Cl.

| | |
|---|---|
| ***H01B 13/20*** | (2006.01) |
| ***H01B 13/22*** | (2006.01) |
| ***H01B 3/44*** | (2006.01) |
| *H01B 13/32* | (2006.01) |
| *H01B 7/04* | (2006.01) |
| *H01B 7/18* | (2006.01) |
| *H01B 13/14* | (2006.01) |

(52) U.S. Cl.

CPC ..... *H01B 13/22* (2013.01); *H01B 3/445* (2013.01); *H01B 7/046* (2013.01); *H01B 7/1895* (2013.01); *H01B 13/145* (2013.01); *H01B 13/148* (2013.01); *H01B 13/329* (2013.01)

(58) Field of Classification Search

CPC ..... H01B 13/22; H01B 3/445; H01B 13/329; H01B 13/148; H01B 7/1895; H01B 13/145; H01B 7/046; Y10T 29/117; Y10T 29/49123

USPC ..... 29/825, 828, 34 D, 33 F, 868; 156/48, 156/78, 244.11; 174/102 R, 110 F, 110 FC; 427/118; 521/98, 145

See application file for complete search history.

(56) References Cited

U.S. PATENT DOCUMENTS

| | | | | | |
|---|---|---|---|---|---|
| 4,304,713 | A | * | 12/1981 | Perelman | C08J 9/0061 174/110 F |
| 4,352,701 | A | * | 10/1982 | Shimba | B29C 44/322 174/110 F |
| 4,368,350 | A | | 1/1983 | Perelman | |
| 4,435,613 | A | * | 3/1984 | Gaubert | H01B 7/285 156/48 |
| 4,560,829 | A | * | 12/1985 | Reed | C08J 9/146 29/828 |
| 4,583,020 | A | | 4/1986 | Cliquet et al. | |

(Continued)

*Primary Examiner* — Donghai D Nguyen
(74) *Attorney, Agent, or Firm* — Hayes Soloway, P.C.

(57) ABSTRACT

A system and method for a down-hole cable is provided. The down-hole cable includes an insulated conductor portion. A filler layer abuts and encapsulates the insulated conductor portion, wherein the filler layer is substantially formed with a foamable fluoropolymer. At least one additive is mixed with the foamable fluoropolymer filler layer. An armor shell is applied to the exterior of the foamable fluoropolymer filler layer with the at least one additive. A bond is formed between the foamable fluoropolymer filler layer with the at least one additive and an internal surface of the armor shell.

7 Claims, 4 Drawing Sheets

(56) References Cited

U.S. PATENT DOCUMENTS

| | | | | |
|---|---|---|---|---|
| 4,764,538 | A * | 8/1988 | Buckmaster | C08J 9/0066 521/145 |
| 5,283,390 | A | 2/1994 | Hubis et al. | |
| 5,770,819 | A | 6/1998 | Mehan | |
| 5,821,452 | A | 10/1998 | Neuroth et al. | |
| 5,831,215 | A | 11/1998 | Ziemek et al. | |
| 7,290,329 | B2 | 11/2007 | Magner | |
| 7,476,809 | B2 | 1/2009 | Magner | |
| 2006/0254792 | A1 | 11/2006 | Kimura et al. | |
| 2009/0196557 | A1 | 8/2009 | Varkey et al. | |
| 2013/0164441 | A1 * | 6/2013 | Magner | H01B 3/445 427/118 |

* cited by examiner

METHOD OF MAKING A DOWN-HOLE CABLE HAVING A FLUOROPOLYMER FILLER LAYER

CROSS REFERENCE TO RELATED APPLICATION

This application is a continuation-in-part of U.S. application Ser. No. 13/071,941 filed Mar. 25, 2011, now abandoned, which claims the benefit of U.S. Provisional Application Ser. No. 61/318,482 filed Mar. 29, 2010, entitled, "Down-hole Cable Having a Fluoropolymer Filler Layer", the entire disclosure of which is incorporated herein by reference.

FIELD OF THE DISCLOSURE

The present disclosure is generally related to cables and more particularly is related to a down-hole cable having a fluoropolymer filler layer.

BACKGROUND OF THE DISCLOSURE

Down-hole cables are found in use in many industries including those that conduct deep drilling, such as within the oil drilling industry. These cables may be used to transmit information and data from a drilling region having the drilling equipment to a control center located remote to the drilling region. Many oil-drilling regions are located deep within the Earth's crust, such as those seen with onshore and offshore drilling. The drilling region may be 5,000 feet or more from a control center located on the Earth's surface or a control center located on water at sea level. A cable of 5,000 feet or more may have a high weight that, when located vertically down a drilling hole distorts the structure of the cable itself. This may result in a failure of the cable or a deformity of the cable that renders it more inefficient than a non-deformed cable.

Current cables include a filler constructed from solid polypropylene that surrounds a conductor and enclosed with an armored sheath, such as a superalloy like Incoloy or a stainless steel. The purpose of the polypropylene filler is to provide a compressive force between the conductor core and the armored sheath, thereby producing a force to retain the conductor core within the cable. The force produced by the solid polypropylene filler may counteract a pullout force, which is the force necessary to remove the conductor core from the cable. The polypropylene fillers that are used are rated at 150° C. and therefore are frequently unable to retain their integrity when the cable is being produced using a heated method. This is due to the inherent crystallinity of the extruded polypropylene filler and the after effect additional heat cycles from the encapsulation extrusion of the armored sheath. These additional heat cycles cause a phase shift in the polypropylene, which in effect, reduce the diameter of the material, which lessens the pullout force necessary to compromise the cable. The encapsulation extrusion process has temperatures that are greater than the annealing temperature of the polypropylene facilitating the phase shift. This results in a cable that may easily be damaged from its own weight creating a pullout force on the conductor core resulting in the conductor core moving within the cable.

Thus, a heretofore unaddressed need exists in the industry to address the aforementioned deficiencies and inadequacies.

SUMMARY OF THE DISCLOSURE

Embodiments of the present disclosure provide an apparatus and method for a down-hole cable. Briefly described, in architecture, one embodiment of the system, among others, can be implemented as follows. The down-hole cable includes an insulated conductor portion and a filler layer abutting and encapsulating the insulated conductor portion, wherein the filler layer is substantially formed with a foamable fluoropolymer. At least one additive is mixed with the foamable fluoropolymer filler layer. An armor shell is applied to the exterior of the foamable fluoropolymer filler layer with the at least one additive. A bond is formed between the foamable fluoropolymer filler layer with the at least one additive and an internal surface of the armor shell.

The present disclosure can also be viewed as providing methods for making a down-hole cable. In this regard, one embodiment of such a method, among others, can be broadly summarized by the following steps: extruding a pre-foamed foamable filler layer about an insulated conductor, wherein the pre-foamed foamable filler layer further comprises a fluoropolymer and an additive; applying an armor shell about the insulated conductor and the pre-foamed foamable filler layer with additive; pressure-testing the armor shell by pressurizing at least one cavity formed between the pre-foamed foamable filler layer with additive and the armor shell; and after pressure-testing, foaming the foamable filler layer with additive into a foamed state, wherein at least a portion of the foamed filler layer with additive bonds to an interior surface of the armor shell, wherein the foamed filler layer with additive withstands a pullout force at temperatures of temperatures above 200° C.

Other systems, methods, features, and advantages of the present disclosure will be or become apparent to one with skill in the art upon examination of the following drawings and detailed description. It is intended that all such additional systems, methods, features, and advantages be included within this description, be within the scope of the present disclosure, and be protected by the accompanying claims.

BRIEF DESCRIPTION OF THE DRAWINGS

Many aspects of the disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

DETAILED DESCRIPTION

Figure 1:
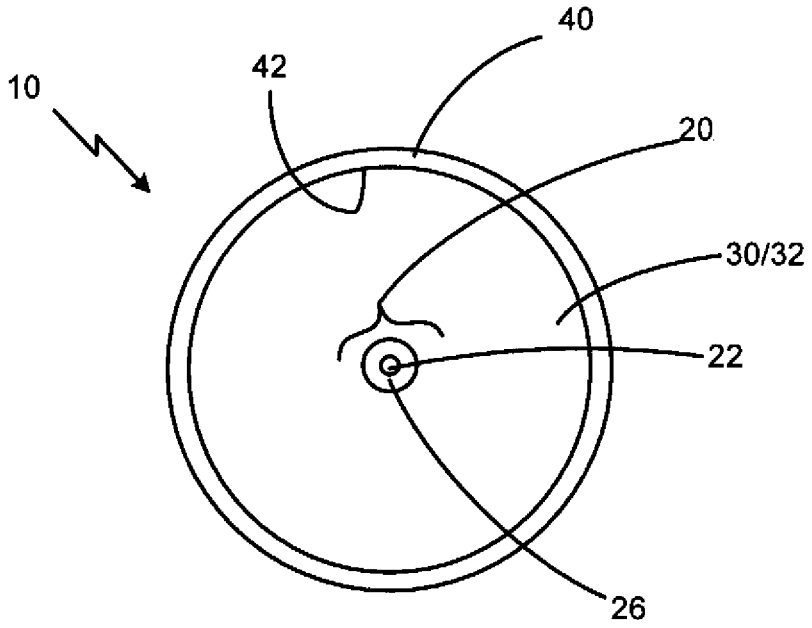
FIG. 1 is a cross-sectional illustration of a down-hole cable, in accordance with a first exemplary embodiment of the present disclosure.

FIG. 1 is a cross-sectional illustration of a down-hole cable 10, in accordance with a first exemplary embodiment of the present disclosure. The down-hole cable 10, hereinafter, "cable 10" may also be referred to as a tube-encapsulated conductor, a permanent down-hole cable, or simply as a cable. The cable 10 includes an insulated conductor portion 20. A filler layer 30 abuts and encapsulates the insulated conductor portion 20, wherein the filler layer 30 is substantially formed with a foamable fluoropolymer. At least one additive mixed 32 with the foamable fluoropolymer filler layer 30. An armor shell 40 applied to the exterior of the foamable fluoropolymer filler layer 30 with the at least one additive 32, wherein a bond is formed between the foamable fluoropolymer filler layer 30 with the at least one additive 32 and an internal surface 42 of the armor shell 40. The cable 10 may be any wire, transmission line or similar structure that may be used in deep drilling operations, such as with onshore or offshore oil drilling. The insulated conductor portion 20 may include any material, which is capable of facilitating movement of electric charges, light or any other communication medium. The insulated conductor portion 20 may include at least one conductor material 22, such as copper, aluminum, alloys, fiber electric hybrid materials, fiber optical material or any other material known within the industry. The insulation surrounding at least one conductor material 22 may include any type of insulation. The insulated conductor portion 20 may be capable of facilitating movement of energy capable of powering a device or facilitating a communication or control signal between devices. The insulated conductor portion 20 may be located at substantially the center of the cable 10, but may also be located off-center or in another position as well. As is discussed with respect to FIG. 2, more than one insulated conductor portion 20 may be included.

Surrounding the insulated conductor portion 20 and fully encapsulating it is a foamed fluoropolymer filler layer 30. The filler layer 30 is formed substantially from a foamed fluoropolymer. This may include any foamed fluorocarbon based polymer with multiple strong carbon-fluorine bonds, such as materials like FEP (fluorinated ethylene-propylene), PFA (perfluoroalkoxy polymer resin), MFA (modified fluoroalkoxy), ETFE (polyethylenetetrafluoroethylene), ECTFE (polyethylenechlorotrifluoroethylene), PVDF (polyvinylidene fluoride), TPX (polymethylpentene), PEEK (polyether ether keytone), copolymers, synthetic polymers or any other fluoropolymer. Common trade names for some of these materials may include Tefzel®, Halar®, Nylon and Kynar®. The foamed fluoropolymer filler layer 30 has a foamed structure that is unlike the solid structure of polypropylene materials.

At least one additive 32 may be added to the filler layer 30. The additive 32 may include a powdered polytetrafluoroethylene (PTFE), commonly known under the brand name TEFLON®. The additive 32 may be in the form of a powder, such as a PTSD powder known under the brand name ZONYL® MP1300. The additive 32 is mixed with the fluoropolymer filler layer 30, preferably integrally, so the combination of the filler layer 30 and additive 32 are fully combined. The additive 32 may assist with preventing the filler layer 30 from sticking to the insulated conductor portion 20, which may prevent proper foaming of the filler layer 30. For example, the additive 32 may impart a low surface energy into the filler layer 30 to enhance nonstick characteristics of the filler layer 30.

The foamed fluoropolymer filler layer 30 and additive 32 may be manufactured on an extrusion line with a nitrogen port in the barrel of the extruder. The nitrogen may be injected into the barrel at the extrusion process to create the foamed cell structure. This cell structure may be present in the entire filler layer 30 and be capable of providing a compressive force on the insulated conductor portion 20. The foamed fluoropolymer layer 30 with additive 32 may also be formed through any other foaming process, wherein a foam having a substantially high viscous is directed proximate to the insulated conductor portion 20 and processed to have a substantially low viscosity. Foamed fluoropolymer may also have a high annealing temperature, whereby it can retain its integrity throughout an annealing process. This may include annealing processes that exceed 150° C., 175° C., 200° C., 250° C., 300° C., 350° C. or any other known annealing temperature. Preferably, the foamed fluoropolymer filler layer 30 will be able to exceed temperatures up to 250° C. The foamed cellular structure of the fluoropolymer may provide a stable matrix of material, which increases the compression on the insulated conductor portion 20 thereby increasing the effective pullout force on the cable.

The armor shell 40 is a sheath or exterior coating or layer that is applied to an exterior surface of the foamed fluoropolymer filler layer 30 and protects the inner components of the cable 10. The armor shell 40 may be substantially hardened, metal or metal alloy, as is known in the art, and may be substantially concentric to the insulated conductor portion 20 and constructed from a strong material, such as a stainless steel or Incoloy®. The armor shell 40 may protect the cable 10 from foreign objects penetrating the cable 10, such as debris from a drilling process. The armor shell 40 may also support the cable 10 to an anchoring position or between two anchoring positions. For example, the cable 10 may be anchored on one end with the armor shell 40 whereby the other end of the cable 10 is located in a vertical direction within the Earth, such as when it is placed down a drilling hole. The armor shell 40 may also include any woven, solid, particulate-based and layered protecting materials.

The foamed fluoropolymer filler layer 30 and additive 32 may be the only material between the insulated conductor portion 20 and the armor shell 40. Accordingly, the foamed fluoropolymer includes a cellular structure that provides a compressive force on an exterior surface of the insulated conductor portion 20 and the interior surface of the armor shell 40. This compressive force resists the pullout force within the cable 10, such as that created by gravity acting on a down-hole cable 10. The cable 10 may have any size diameter or length and therefore the insulated conductor portion 20, the foamed fluoropolymer filler layer 30 and the armor shell 40 may have any size or configuration. This may include a foamed fluoropolymer filler layer 30 that is substantially thin in comparison to the armor shell 40 or the insulated conductor portion 20, or a foamed fluoropolymer filler layer 30 that forms the majority of the material within the cable 10.

Further, a bond may be formed between the filler layer 30 having the additive 32 and the internal surface 42 of the armor shell 40. The bond may include a chemical bond that is generated after complete foaming of the filler layer 30. The bond may retain the filler layer 30 to the armor shell 40, thereby preventing separation of the filler layer 30 from the armor shell 40 when a pullout force is applied to the insulated conductor portion 20.

In operation, the cable 10 may be placed vertically, wherein one end of the cable 10 is substantially above the other end of the cable 10. This may include a cable 10 with any length, such as 100 feet, 300 feet, 500 feet or greater, or any other length. For example, the cable 10 may be suspended within a hole drilled within the Earth's crust, wherein one end of the cable 10 is located above the Earth's crust and the other end is located 500 feet or more below the Earth's crust. The cable 10 may be held in this position for any period of time. The cable 10 may be resistant to the pullout force created by gravity acting on the components of the cable 10. In other words, the foamed fluoropolymer filler layer 30 may place a compressive force on the insulated conductor portion 20, which is stronger than any pullout force created by gravity. The cable 10 may also include anchors at any portion of the cable 10 to retain the cable 10 in one or more positions. The cable 10 may be suitable for any vertical use, and may be especially preferable for vertical use spanning a distance of 500 feet or more. As one having ordinary skill in the art would recognize, many variations, configuration and designs may be included with the cable 10, or any component thereof, all of which are considered within the scope of the disclosure.

Figure 2:
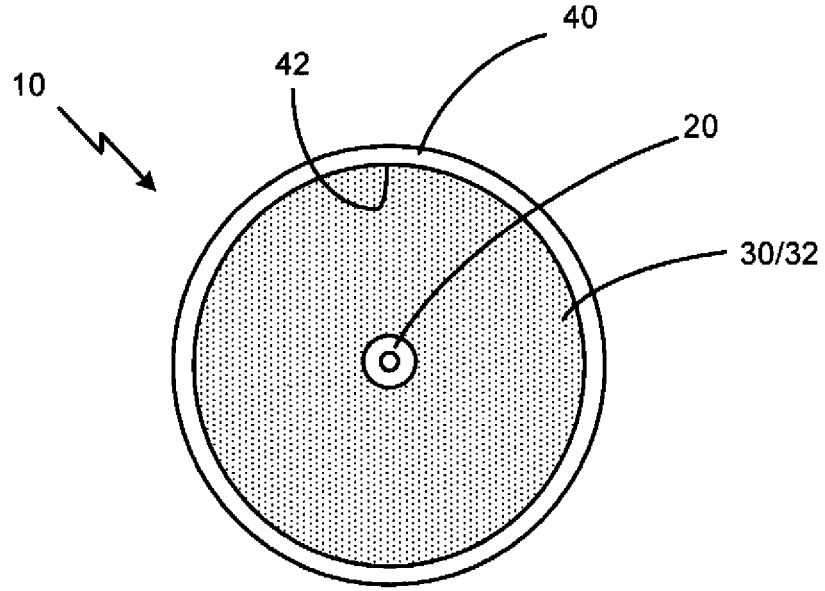
FIG. 2 is a cross-sectional illustration of a down-hole cable, in accordance with a second exemplary embodiment of the present disclosure.

FIG. 2 is a cross-sectional illustration of a cable 10, in accordance with the first exemplary embodiment of the present disclosure. As is shown, the cable 10 includes an insulated conductor portion 20 located near a central axis of the cable 10 and the abutting filler layer 30 that is formed from foamed fluoropolymer and the additive 32 encapsulates the insulated conductor portion 20. The filler layer 30 and additive 32 includes a foamed cell structure, which creates a stable matrix, thereby increasing the effective pullout force throughout the cable 10. The foamed cell structure may be included in all or a portion of the filler layer 30 and additive 32 throughout a cable 10, and is illustrated throughout the filler layer 30 in FIG. 2. For example, the foamed cell structure may be included in only specific sections or segments of the cable 10, or only within a certain radial boundary within the cable 10, such as with a striated foamed design. The foamed cell structure may be produced by a variety of methods, including injecting a quantity of gas, such as nitrogen, into the filler layer 30 and additive 32 as it is extruded in a manufacturing process. Specifically, the extruder used to create the filler layer 30 may include a gas port within the barrel, whereby the gas is injected in the filler layer 30 and additive 32 to create the foamed cell structure. The armor shell 40 is applied to the exterior of the foamed fluoropolymer filler layer 30 and additive 32 with the foamed cell structure and traverses around the circumference of the cable 10. The bond is then created between the foamed fluoropolymer filler layer 30 with the additive 32 and the interior surface 42 of the armor shell 40.

Figure 3:
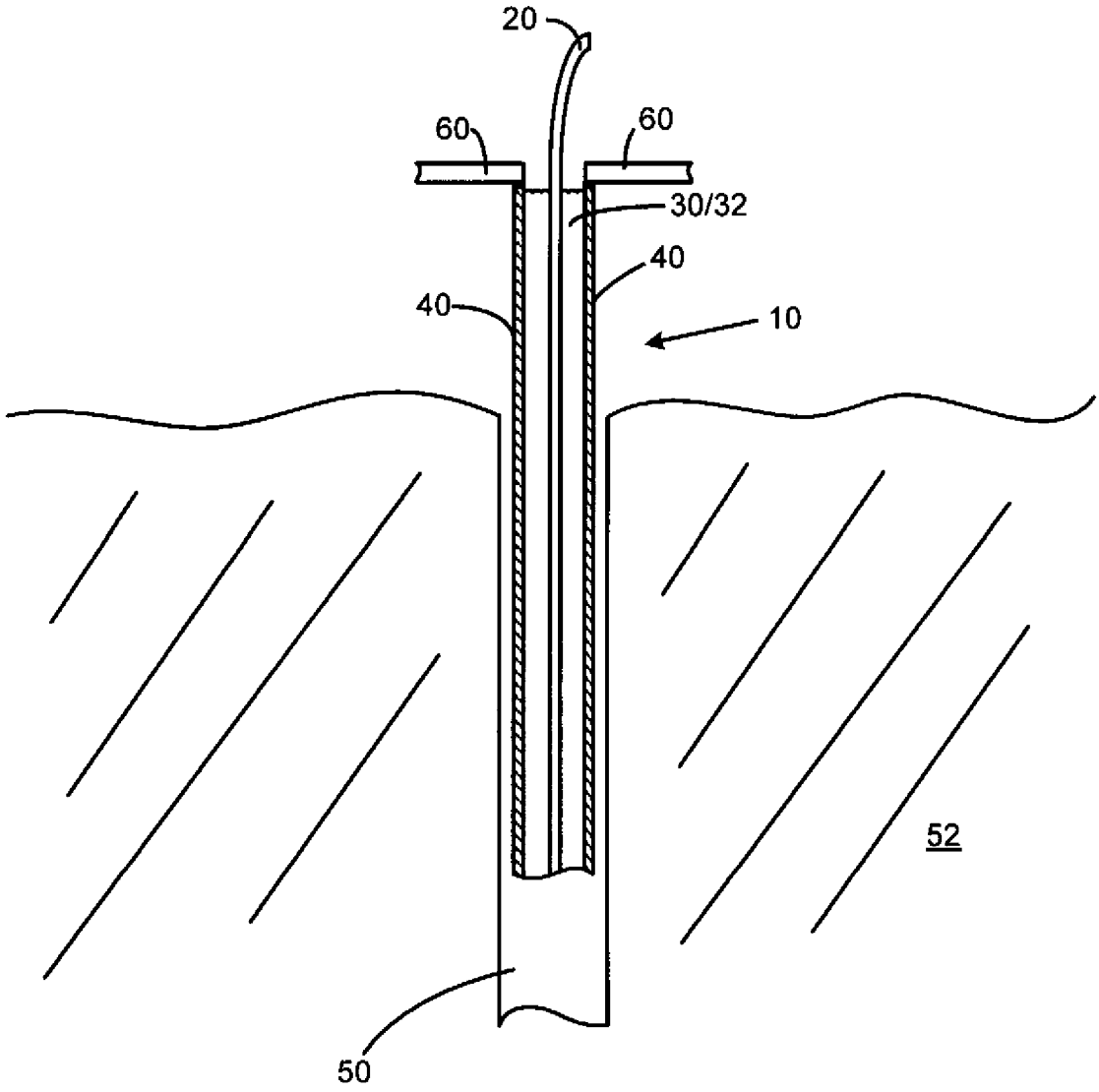
FIG. 3 is a cross-sectional illustration of a cable in an in-use position, in accordance with the first exemplary embodiment of the present disclosure.

FIG. 3 is a cross-sectional illustration of a cable 10 in an in-use position, in accordance with the first exemplary embodiment of the present disclosure. The cable 10 is a down-hole cable for use in substantially vertical positions. For example, the in-use position of the cable 10 may include a substantially vertical orientation where the cable is at least partially placed within a drilled or bored hole within the Earth or a body of water, such as an ocean. FIG. 3 illustrates the cable 10 positioned partially within a hole 50 within the Earth 52. As can be seen, the armor shell 40 of the cable 10 may be positioned proximate to the Earth 52, whereby it may prevent articles within the Earth 52 from penetrating the cable 10. For example, the armor shell 40 may prevent rocks or other objects from damaging the cable 10 while it is placed within the hole 50. Additionally, the armor shell 40 may be used to secure the cable 10 in a specific position via an attachment to one or more anchoring structures 60. In FIG. 3, the anchoring structures 60 are illustrated at an upper end of the cable 10, although they may be placed along any part of the cable 10, including the bottom or a mid-section.

Figure 4:
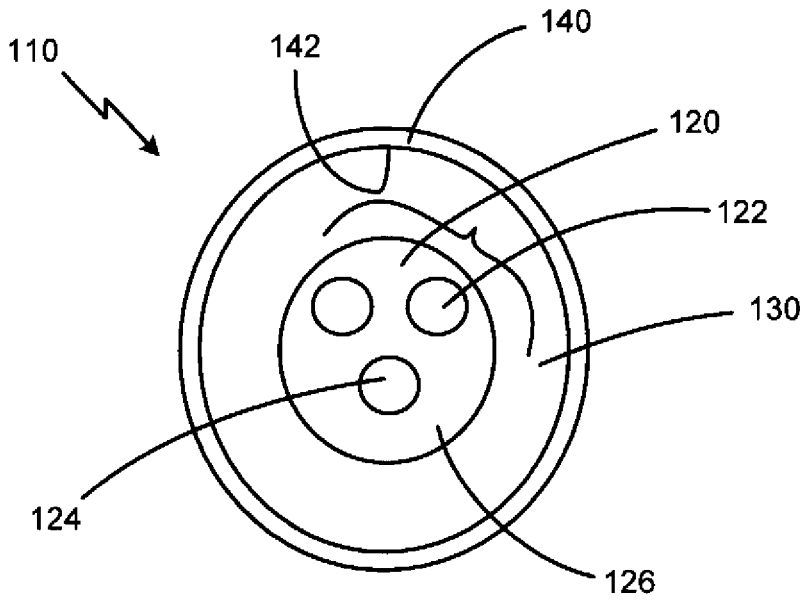
FIG. 4 is a cross-sectional illustration of a cable, in accordance with a second exemplary embodiment of the present disclosure.

FIG. 4 is a cross-sectional illustration of a cable 110, in accordance with a second exemplary embodiment of the present disclosure. The cable 110 is similar to that of the cable 10 of the first exemplary embodiment, and includes at least a first conductor material 122 and a second conductor material 124 within the insulated conductor portion 120. A filler layer 130 abuts and encapsulates the first and second conductor materials 122, 124 of the insulated conductor portion 120, wherein the filler layer 130 is substantially formed with a foamable fluoropolymer. At least one additive mixed 132 with the foamable fluoropolymer filler layer 130. An armor shell 140 applied to the exterior of the foamable fluoropolymer filler layer 130 with the at least one additive 132, wherein a bond is formed between the foamable fluoropolymer filler layer 130 with the at least one additive 132 and an internal surface 142 of the armor shell 140.

The cable 110 may include any of the features or designs disclosed with respect to the first exemplary embodiment. In addition, the cable 110 includes a plurality of conductor materials, i.e., first and second conductor materials 122, 124, which may include two or more solid or other conductor materials. Additionally, the first and second conductor materials 122, 124 may be different conductors, depending on the design and use of the cable 110. The first and second conductor materials 122, 124 may facilitate the transmission of electrical energy through the cable 110, or may facilitate communication of control signals through the cable 110. The foamed fluoropolymer filler layer 130 may apply a compressive force on any one or all of the first and second conductor materials 122, 124 of the insulated conductor portion 120, thereby increasing the pullout force resistance within the cable 110. The plurality of insulated conductor portions 120 may also facilitate transmission of varying signals, such as communication signals on one of the plurality of insulated conductor portions 120 and energy transmission on another of the plurality of insulated conductor portions 120. As one having ordinary skill in the art would recognize, many variations, configuration and designs may be included with the cable 110, or any component thereof, all of which are considered within the scope of the disclosure.

Figure 5:
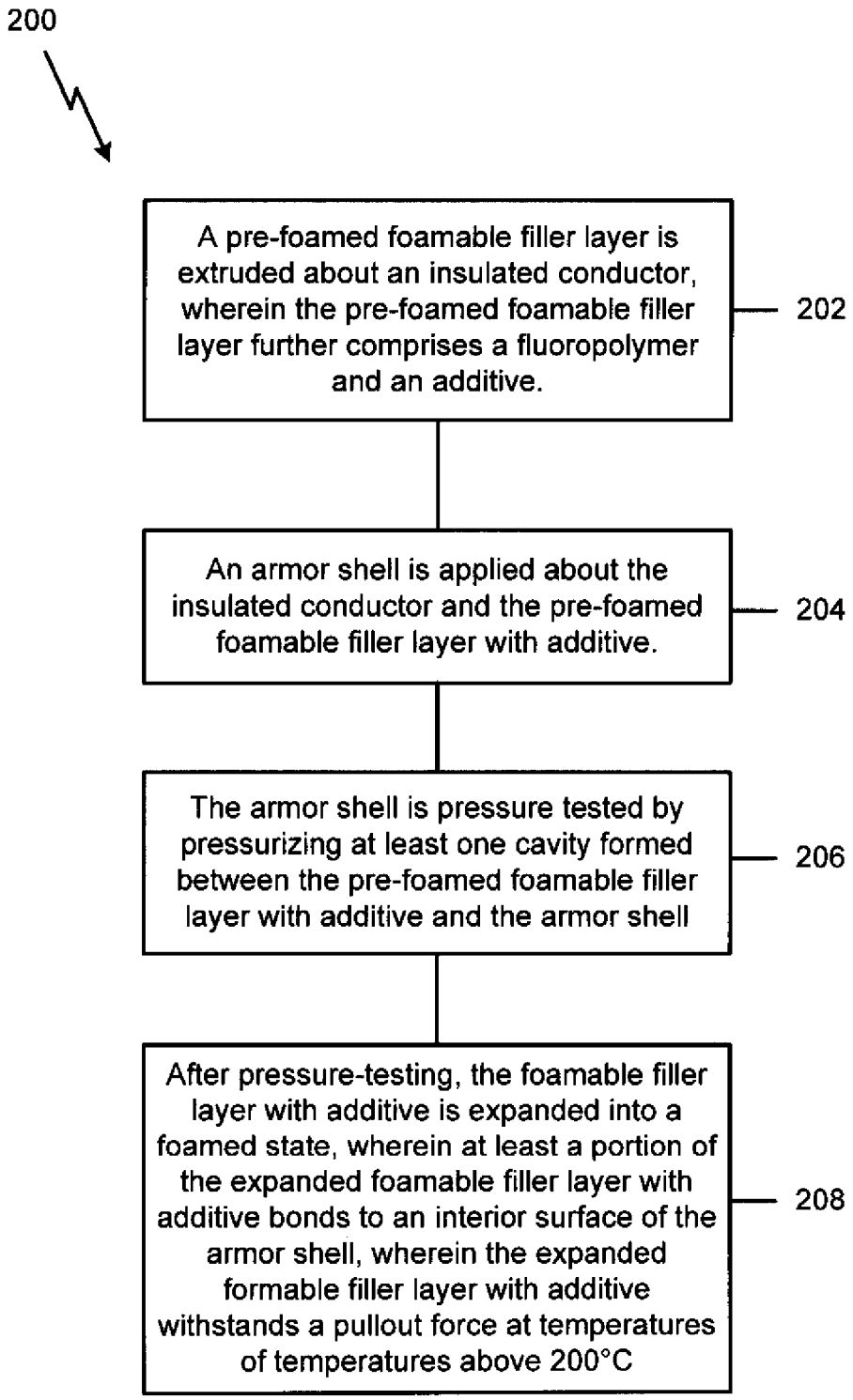
FIG. 5 is a flowchart illustrating a method of making the abovementioned down-hole cable in accordance with the first exemplary embodiment of the disclosure.

FIG. 5 is a flowchart 200 illustrating a method of making the abovementioned down-hole cable 10 in accordance with the first exemplary embodiment of the disclosure. It should be noted that any process descriptions or blocks in flow charts should be understood as representing modules, segments, portions of code, or steps that include one or more instructions for implementing specific logical functions in the process, and alternate implementations are included within the scope of the present disclosure in which functions may be executed out of order from that shown or discussed, including substantially concurrently or in reverse order, depending on the functionality involved, as would be understood by those reasonably skilled in the art of the present disclosure.

As is shown by block 202, a pre-foamed foamable filler layer is extruded about an insulated conductor, wherein the pre-foamed foamable filler layer further comprises a fluoropolymer and an additive. An armor shell is applied about the insulated conductor and the pre-foamed foamable filler layer with additive (block 204). The armor shell is pressure tested by pressurizing at least one cavity formed between the pre-foamed foamable filler layer with additive and the armor shell (block 206). After pressure-testing, the foamable filler layer with additive is expanded into a foamed state, wherein at least a portion of the expanded foamable filler layer with additive bonds to an interior surface of the armor shell, wherein the expanded formable filler layer with additive withstands a pullout force at temperatures of temperatures above 200° C. (block 208).

A variety of additional steps may also be included in the method. For example, the step of foaming the filler layer 30 and additive 32, such as a powdered polytetrafluoroethylene (PTFE), about the insulated conductor portion 20 may include creating a foamed cell structure by gas-injection, such as a nitrogen-injection method during an extrusion process. In addition, foaming the filler layer 30 with additive 32 about the insulated conductor portion 20 may include creating a radial compressive force acting on the insulated conductor portion 20 and the armored shell 40. The radial compressive force withstands a pullout force between the insulated conductor portion 20 and the armored shell 40. The bond between the expanded foamable filler layer 30 and the interior surface 42 of the armor shell 40 may be a chemical bond. The radial compressive force and/or the bond, together or independently, may allow the down-hole cable 10 to withstand pullout forces between the insulated conductor 20 and the armor shell 40 in a variety of temperatures, including temperatures greater than 150° C. and preferably 250° C.

As may be understood, the down-hole cable 10 may be used for a variety of purposes, such as within oil well drilling operations. Accordingly, the any number of signals may be transmitted through any number of conductors within the insulated conductor portion 20. These signals may be any type of signals, such as power signals and/or communication signals used to operate a device or combination of devices. This may include signals for monitoring a device's activity or an environmental activity proximate to the device. As the down-hole cable 10 may be positioned substantially vertically, the armor shell 40 may be connected to at least one anchoring structure. The anchoring structure may support the weight of the down-hole cable 10 via the armor shell 40.

It should be emphasized that the above-described embodiments of the present disclosure, particularly, any "preferred" embodiments, are merely possible examples of implementations, merely set forth for a clear understanding of the principles of the disclosure. Many variations and modifications may be made to the above-described embodiments of the disclosure without departing substantially from the spirit and principles of the disclosure. All such modifications and variations are intended to be included herein within the scope of this disclosure and the present disclosure and protected by the following claim.

What is claimed is:

1. A method of making a down-hole cable, the method comprising the steps of:

extruding a pre-foamed foamable filler layer about an insulated conductor, wherein the pre-foamed foamable filler layer further comprises a fluoropolymer and an additive;

applying an armor shell about the insulated conductor and the pre-foamed foamable filler layer with additive;

pressure-testing the armor shell by pressurizing at least one cavity formed between the pre-foamed foamable filler layer with additive and the armor shell; and after pressure-testing, foaming the foamable filler layer with additive, wherein at least a portion of the foamed filler layer with additive bonds to an interior surface of the armor shell, wherein the foamed filler layer with additive withstands a pullout force at temperatures of temperatures above 200° C.

2. The method of claim 1, wherein the additive further comprises a powdered polytetrafluoroethylene (PTFE).

3. The method of claim 1, wherein the step of foaming the filler layer about the insulated conductor portion further comprises creating a foamed cell structure by chemical reaction.

4. The method of claim 3, wherein the bond between the foamed filler layer and the interior surface of the armor shell further comprises a chemical bond.

5. The method of claim 1, wherein foaming the filler layer about the insulated conductor portion includes creating a radial compressive force acting on the insulated conductor portion and the armored shell, wherein the radial compressive force withstands a pullout force between the insulated conductor portion and the armored shell.

6. The method of claim 1, further comprising the step of transmitting at least one signal through a conducting material within the insulated conductor portion.

7. The method of claim 1, wherein the foamed filler layer withstands a pullout force at temperatures of at least 300° C.

* * * * *